United States Patent [19]

Sheffield

[11] Patent Number: 5,035,056

[45] Date of Patent: Jul. 30, 1991

[54] BANANA SLICER

[76] Inventor: William Sheffield, 33 Tai Tam Road, No. 38E, Tai Tam, Hong Kong

[21] Appl. No.: 449,540

[22] Filed: Dec. 12, 1989

[51] Int. Cl.[5] ..... B26B 3/00

[52] U.S. Cl. ..... 30/305; 30/114

[58] Field of Search ..... 30/114, 304, 305, 299, 30/117

[56] References Cited

U.S. PATENT DOCUMENTS

| | | | |
|---|---|---|---|
| 1,868,401 | 7/1932 | Stuart | 30/305 |
| 3,727,307 | 4/1973 | Berger | 30/304 |
| 4,055,892 | 11/1977 | Del Vecchio | 30/305 |

*Primary Examiner*—Douglas D. Watts

*Attorney, Agent, or Firm*—Klein & Szekeres

[57] ABSTRACT

A utensil or tool specifically adapted for slicing bananas includes a frame which circumscribes an area generally conforming to the shape and size of a typical banana. The frame has two opposing curvilinear longitudinal sides which are interconnected with a plurality of spaced, substantially parallel disposed ribs. The ribs are sufficiently thin to cut transversely through a banana when the utensil is pushed down on a banana. The utensil is held by a user through handles which are attached to ends of the frame. An elongated hole is provided in one of the handles to permit hanging of the utensil on a peg board or the like for storage.

4 Claims, 2 Drawing Sheets

20
22
24
26
27
30
31
32

4
5
20
22
26
27
30
32

22
26
30

BANANA SLICER

BACKGROUND OF THE INVENTION

1. Field of the Invention

The present invention is in the field of kitchen and cutting utensils and implements. More particularly, the present invention is directed to a banana slicer.

2. Brief Description of the Prior Art

Cheese slicers and slicers for hard boiled eggs are known in the prior art. Such known slicers of the prior art usually utilize thin wires as cutting edges. More specifically, one type of cheese slicer of the prior art comprises a single thin wire tautly mounted in a suitable frame, and a handle which is grasped by the user while manipulating the frame and wire to cut slices off a block of cheese. Another type of slicer of the prior art used primarily for slicing hard boiled eggs, comprises a bottom support piece configured to accept a hard boiled egg, and a top piece having a plurality of spaced, parallel disposed taut thin wires. The top piece is hingedly mounted to the bottom piece, and the hard boiled egg is cut into a plurality of slices when the hinged top piece is pushed down on the egg.

Although people often slice bananas in connection with preparation of fruit salads, dishes containing cereals and other culinary items, people usually have to use a knife for cutting the banana slices one by one. The present inventor is unaware of the existence of slicing utensils or tools specially adapted for bananas. The present invention provides a utensil or implement for cutting an entire banana into a plurality of slices in one single cutting operation.

SUMMARY OF THE INVENTION

It is an object of the present invention to provide a utensil or tool which is particularly adapted for slicing bananas.

It is another object of the present invention to provide a utensil or tool which is adapted for slicing a banana into a plurality of slices in a single operation of the tool.

It is still another object of the present invention to provide a utensil or tool which is adapted for slicing a banana into a plurality of slices and from which the slices are easily removed.

It is yet another object of the present invention to provide a utensil or tool for slicing bananas which meets the above-noted objectives and which is simple to use and relatively inexpensive to manufacture.

The foregoing and other objects and advantages are attained by a utensil or slicing tool which has a frame circumscribing an area into which a typical banana readily fits, and a plurality of spaced ribs or blades disposed transversely to the longitudinal axis of the frame and interconnecting opposite sides of the frame. The ribs or blades are sufficiently thin to serve as cutting edges for a banana and are spaced apart at a distance which corresponds to the thickness of the banana slices to be cut, for example the space between the ribs is in the range of 3 mm to 10 mm. The utensil is utilized by disposing it on top of a banana resting on a hard surface (such as a table top, board or plate) and by pushing the utensil down on the banana.

The features of the present invention can be best understood together with further objects and advantages by reference to the following description, taken in connection with the accompanying drawings, wherein like numerals indicate like parts.

DESCRIPTION OF THE PREFERRED EMBoDIMENT

Figure 1:
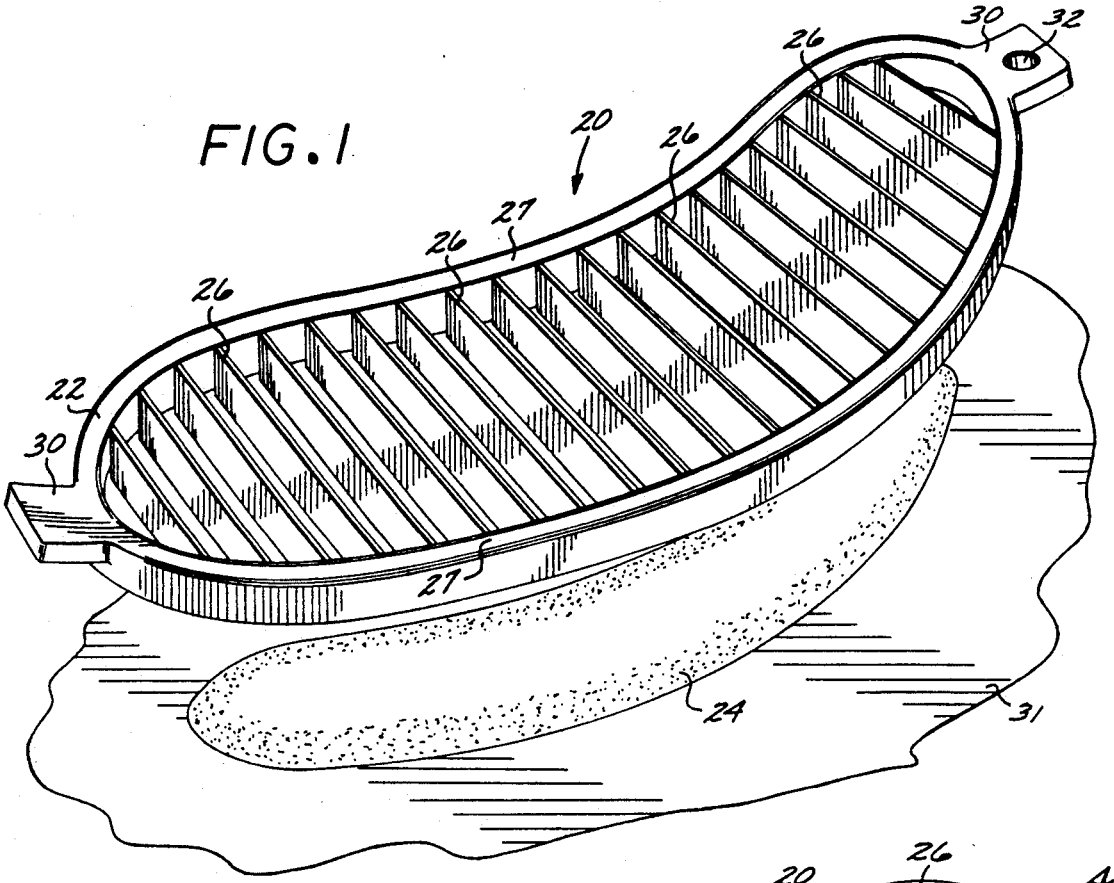
FIG. 1 is a perspective view of the preferred embodiment of the banana slicer of the present invention, the view also showing a banana which is about to be sliced.
Figure 2:
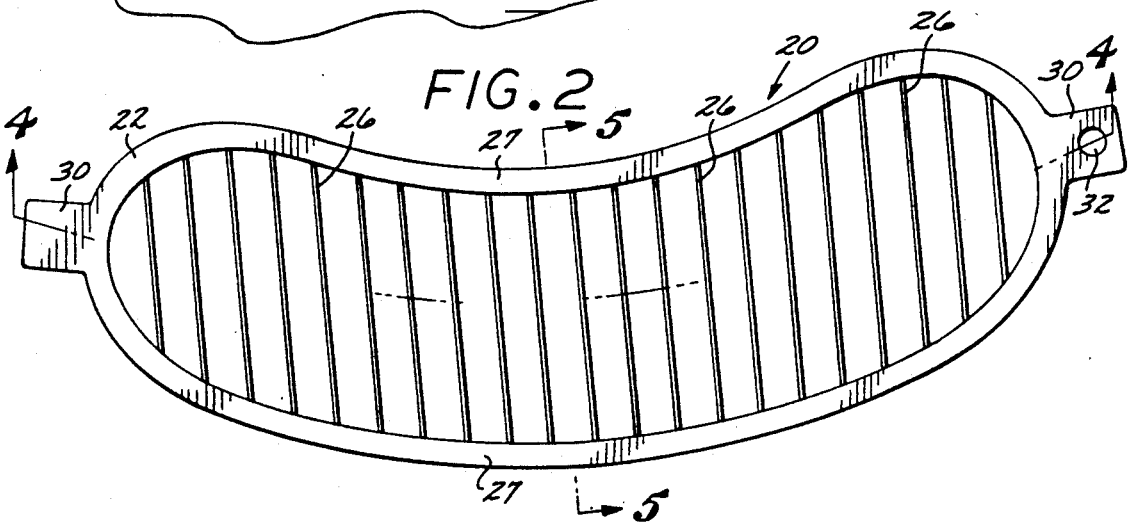
FIG. 2 is a top view of the preferred embodiment of the banana slicer of the present invention.

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Referring now to the drawing Figures, the preferred embodiment 20 of the banana slicer of the present invention is disclosed. It should be noted at the outset that the banana slicer of the invention is preferably made from plastic materials, and is more preferably made by a relatively simple and inexpensive manufacturing process which is well adapted for mass production, such as plastic molding. The herein described preferred embodiment is made from high density polyethylene, although other materials, and particularly other plastic materials are also suitable. The herein described preferred embodiment, manufactured by plastic molding, comprises a single, unitary piece, which is described in detail below.

Thus, the preferred embodiment 20 comprises a substantially flat frame 22, which circumscribes an area sufficiently large to contain a typical banana 24, even a large banana, laid to rest on its side. The foregoing is shown on the exploded perspective view of FIG. 1. Preferably, as it is revealed by the drawing figures which depict the preferred embodiment 20 of the invention, the frame 22 of the banana slicer conforms to the curvature of a typical or ordinary banana 24. Thus, the banana slicer 20 is elongated and the frame 22 is curvilinear so that the slicer fits on top of a typical banana 24, as is specifically shown on FIG. 1.

A plurality of spaced, substantially parallel disposed blades or ribs 26 interconnect two elongated sides 27 of the frame 22. The positioning of the blades or ribs 26 is such that when the banana slicer 20 is laid to rest on a substantially horizontal flat support surface (not shown), the blades or ribs 26 are disposed substantially vertically. In accordance with the invention, the blades or ribs 26 must be sufficiently thin so as to be able to serve as cutting tools capable of cutting through a banana 24, without having a specially sharpened wedge shaped cutting edge. On the other hand, because the blades 26 are preferably made from plastic, they cannot be so thin or narrow that their structural integrity would be compromised, or so thin that they could not be manufactured by suitable manufacturing processes, such as plastic molding. For these reasons, the blades or ribs 26 of the preferred embodiment are approximately 1 mm wide, although it should be understood that their width can vary for as long as the foregoing requirements are met. For example, when the blades 26 are made from high density polyethylene, their thickness can be as little 0.9 to 0.8 mm, without compromising their structural integrity.

As it will be readily understood by those skilled in the art, spacing between the blades or ribs 26 substantially determines the thickness of the banana slices 28 which are cut with the utensil of the present invention. Whereas the spacing of the blades 26 can vary appreciably depending on preference for thicker or thinner banana slices, in the herein described preferred embodiment 20 the blades 26 are approximately 4.0 mm (precisely 4.2 mm) apart.

Figure 4:
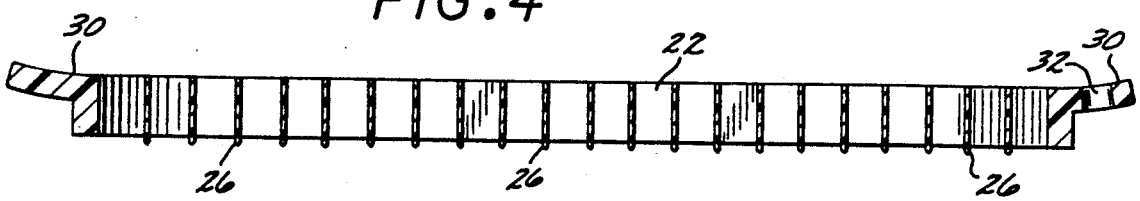
FIG. 4 is a cross-sectional view taken on lines 4,4 of FIG. 2.
Figure 5:
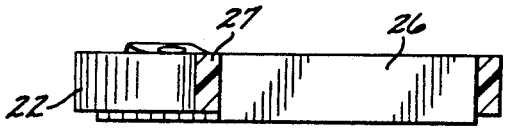
FIG. 5 is a cross-sectional view taken on lines 5,5 of FIG. 2.

Referring now primarily to the cross-sectional views of FIGS. 4 and 5, the blades 26 of the preferred embodiment are shown to extend slightly (approximately 1.5 mm) below the frame 22, so that when the banana slicer 20 is placed on a support surface, such as a table (not shown) or plate (not shown) the banana slicer 20 rests on the bottom of the blades 26 and not on the frame 22. The slicer 20 of the preferred embodiment is approximately 28 cm long, and at its widest point it is approximately 6.3 cm wide. Although the number of blades or ribs 25 is not critical, it is noted that the herein described preferred embodiment 20 has seventeen (17) spaced ribs 26.

Figure 3:
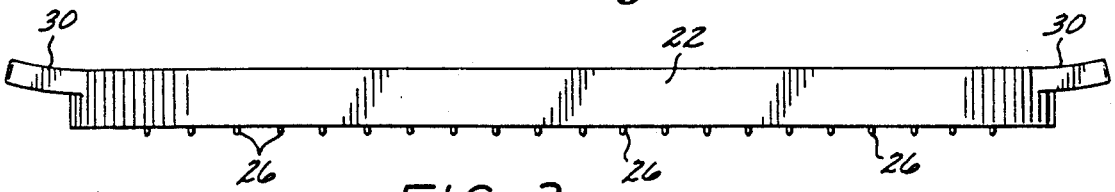
FIG. 3 is a side view of the preferred embodiment of the banana slicer of the present invention.
Figure 6:
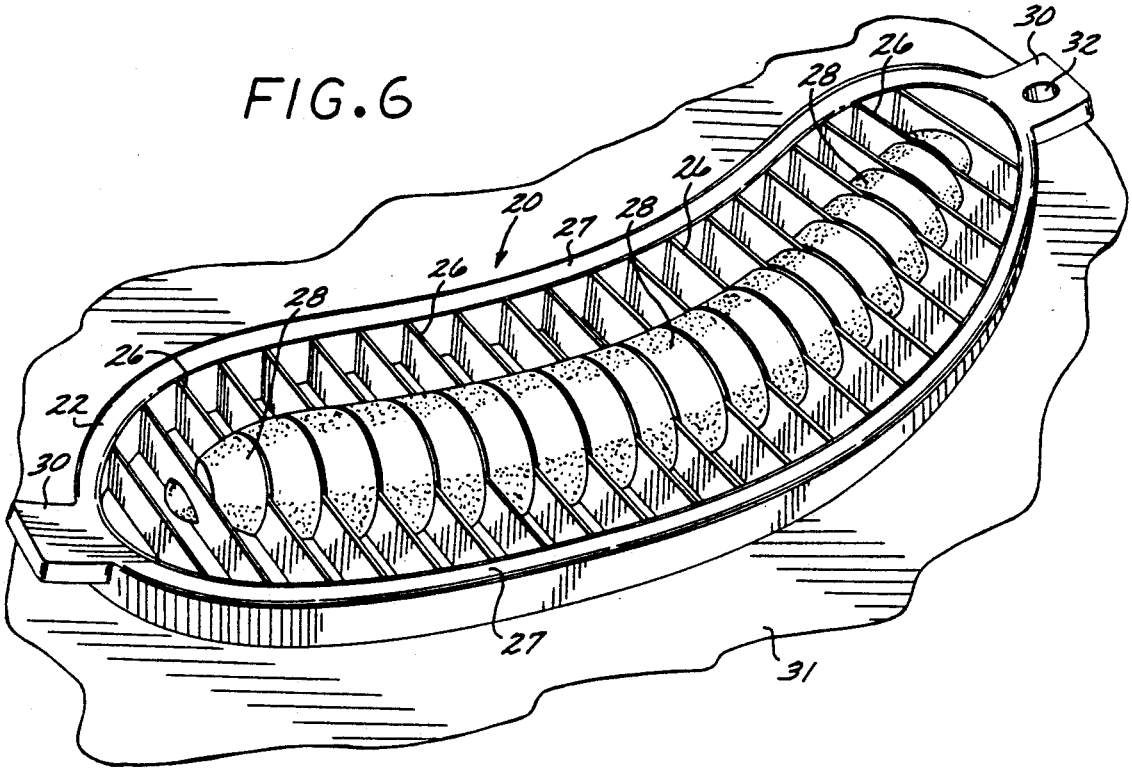
FIG. 6 is another perspective view of the preferred embodiment of the banana slicer of the present invention, the view showing a plurality of banana slices obtained by using the slicer.

Referring now primarily to FIGS. 1, 3 and 6, the ends 30 of the banana slicer 20 of the preferred embodiment are shown to curve upward, out of the plane generally defined by the frame 22. The upwardly curved or bent ends 30 make it easier for a user (not shown) to hold and manipulate the slicer 20, especially after the slicer 20 has been used to cut a banana 24, as is shown on FIG. 6 of the appended drawings. In this regard it is noted that a banana 24 is conveniently sliced by the utensil of the present invention by first laying the banana 24 on a support surface 31, and thereafter holding the slicer 20 substantially parallel with the banana 24 and pushing the slicer 20 down on the banana 24. The foregoing is shown schematically on FIG. 1. The freshly cut banana slices 28 have a tendency to adhere to, or "stick", to the blades or ribs 26 of the slicer 20. Therefore, it is usually possible for a user (not shown) to lift the slicer 20 while the freshly cut banana slices 28 are still attached, turn the slicer 20 over, and using hands or with the help of a fork (not shown), spoon (not shown), or other instrument (not shown), gather the slices 28 into a bowl (not shown), container (not shown) or the like. A hole or opening 32 is provided in one end 30 of the slicer 20 to enable a user (not shown) to hang the slicer 20 for storage on a peg board (not shown), or the like.

Several modification of the above-described invention may become readily apparent to those skilled in the art in light of the foregoing disclosure. Therefore, the scope of the present invention should be interpreted solely from the following claims, as such claims are fairly read in light of the disclosure.

What is claimed is:

1. A utensil for slicing bananas comprising:

an elongated plastic frame generally defining a plane and configured to circumscribe an area conforming to the shape and area of a typical banana, the frame having curvilinear opposite longitudinal sides;

a plurality of substantially evenly spaced, substantially parallel disposed ribs integral with the frame and interconnecting the curvilinear opposite longitudinal sides of the frame, each of the ribs being sufficiently thin to form means for cutting transversely through a banana, the spaces between the ribs defining thickness of banana slices cut by the utensil, and a pair of handles, each of the handles being integral with and attached to a longitudinal end of the frame and curved upward, away from the plane of the frame, at least one of the handles including a hole wherethrough the utensil can be hung for storage on a peg board or the like.

2. The banana slicing utensil of claim 1 consisting essentially of high density polyethylene.

3. The banana slicing utensil of claim 1 wherein each rib is approximately 1 mm thick.

4. The banana slicing utensil of claim 1 wherein the ribs are disposed at an approximate distance of 4 mm from one another.

* * * * *